United States Patent [19]

Sasaki et al.

[11] 3,935,492

[45] Jan. 27, 1976

[54] IONIZATION SMOKE DETECTOR

[75] Inventors: Koju Sasaki, Tokyo; Akihiro Kobayashi, Fujisawa, both of Japan

[73] Assignee: Nittan Company, Ltd., Tokyo, Japan

[22] Filed: May 3, 1973

[21] Appl. No.: 357,071

Related U.S. Application Data

[63] Continuation of Ser. No. 89,417, Nov. 13, 1970, abandoned.

[52] U.S. Cl. ..... 313/54; 250/381; 340/237 S

[51] Int. Cl. ..... H01j 17/32

[58] Field of Search ..... 313/54; 340/237 S; 250/381

[56] References Cited

UNITED STATES PATENTS

| | | | |
|---|---|---|---|
| 2,408,051 | 9/1946 | Donelian | 313/54 X |
| 2,702,898 | 2/1955 | Meili | 340/237 S |
| 3,460,124 | 8/1969 | Smith et al. | 340/237 S |
| 3,514,603 | 5/1970 | Klein | 340/237 S X |
| 3,582,646 | 6/1971 | Ponsar | 313/54 X |

*Primary Examiner*—Nathan Kaufman

*Attorney, Agent, or Firm*—Eugene E. Geoffrey, Jr.

[57] ABSTRACT

An ionization smoke detector having two ionization chambers with one of said chambers having an electrode at least partially surrounded by a conductive mesh constituting an intermediate electrode and the other of said chambers being formed between the intermediate electrode and an outer surrounding electrode of conductive mesh and a radioactive source carried by said outer electrode. The volume defined by the outer and intermediate electrodes is greater than the volume defined by the intermediate electrode.

4 Claims, 3 Drawing Figures

INVENTORS
KOJU SASAKI
AKIHIRO KOBAYASHI
BY
Eugene E. Lipsky Jr.
ATTORNEY

IONIZATION SMOKE DETECTOR

This application is a continuation of application Ser. No. 89,417 filed Nov. 13, 1970 entitled Ionization Smoke Detector, now abandoned.

This invention relates to an ionization smoke detector and especially to an improved ionization smoke detector having a simplified structure.

Ionization smoke detectors according to prior art include a pair of ionization chambers connected in series between the terminals of a voltage source and each having a pair of electrodes and a radioactive source respectively therein. One of the ionization chambers is closed to the air and referred to as a "closed ionization chamber," while the other is open to the air so as to allow smoke to come in and is referred to as an "open ionization chamber." A field effect transistor having a gate electrode connected to the junction between the both ionization chambers and a source-drain conduction path connected through a load resistor between the both terminals of the voltage source is provided for detecting a potential change at the junction of the both ionization chambers. When smoke enters in the open ionization chamber, the ionization current in the open ionization chamber varies, and this results in a change of impedance of the open ionization chamber and a change of a potential at the junction between the both ionization chambers, that is, at the gate electrode of the field effect transistor which in turn drives an alarm device to give an alarm.

In the foregoing types of ionization smoke detectors having open and closed ionization chambers, at least two radioactive sources are needed for the both ionization chambers. This makes the device unnecessarily complicated and costly.

Therefore, an object of the invention is to provide an ionization smoke detector which needs only one radioactive source but exhibits high degree of sensitivity.

According to this invention, the ionization smoke detector has three electrodes concentrically or coaxially disposed, that is, an outermost electrode, an intermediate electrode and an innermost electrode. The outermost electrode surrounds the intermediate electrode to form an outer ionization chamber therebetween and the intermediate electrode surrounds the innermost electrode to form an inner ionization chamber therebetween. The outermost electrode and the intermediate electrode are made of a material, such as metal wire netting, which allows an entrance of the external air and penetration of radiant rays. A single radioactive source is disposed so that the both outer and inner ionization chambers are commonly irradiated by the single radioactive source.

Other objects and features of this invention will be best understood from the following description with reference to the accompanying drawings.

In the drawings.

Throughout the drawings, same reference numerals are given to like structural elements.

Figure 1:
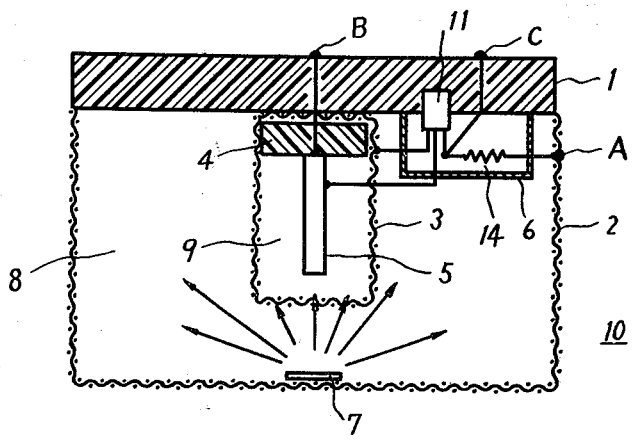
FIG. 1 is a schematic view representing an embodiment of the ionization smoke detector according to this invention.

Referring now to FIG. 1, a detector which is generally denoted by the numeral 10 includes three electrodes, that is, a cylindrical outer electrode 2, a cylindrical intermediate electrode 3 and a rod-like inner electrode 5, which are coaxially supported by insulator disc members 1 and 4 consisting of acryl resin or the like. The outer electrode 2 and the intermediate electrode 3 are composed of metal wire netting and define respectively an outer ionization chamber 8 and an inner ionization chamber 9 in which the external air can enter freely. A single radioactive source 7 is disposed in the center of the bottom of the outer electrode 2 so that the inner ionization chamber 9 as well as the outer ionization chamber 8 are irradiated by the radiant ray from the radioactive source 7.

A field effect transistor 11 is embedded in the insulator disc 1 and has a gate electrode G connected to the intermediate electrode 3, a source electrode S connected through a load resistor 14 to the outer electrode 2 and a drain electrode D connected to the inner electrode 5. The field effect transistor 11 and the load resistor 14 are covered by a suitable cover 6 so as not to be affected by the external atmosphere and the radiant rays. The detector 10 has three terminals A, B, and C respectively connected to the outer electrode 2, the inner electrode 5, and the junction between the load resistor 14 and the source electrode of the field effect transistor 11.

Figure 2:
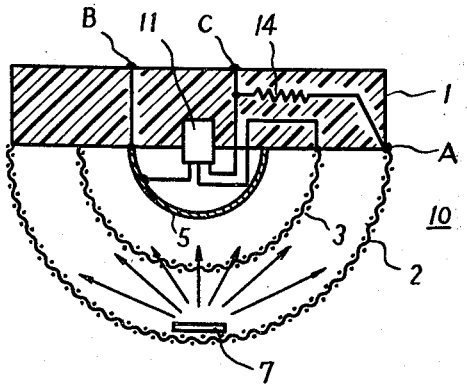
FIG. 2 is a schematic view representing another embodiment of ionization smoke detector according to this invention.

FIG. 2 shows another embodiment of the ionization smoke detector according to this invention. This detector 10 has hemispherical outer, intermediate and inner electrodes 2, 3, and 5 which are arranged concentrically on an insulator disc 1. The outer and intermediate electrodes 2 and 3 are composed of metal wire netting and the inner electrode 5 is composed of a metallic shell. A radioactive source 7 is disposed in the center of the inner face of the outer electrode 2. A field effect transistor 11 embedded in the insulator disc 1 and covered by the inner electrode shell 5 is connected similarly to the case of the device of FIG. 1 in that the gate G is connected to electrode 3, drain D is connected to electrode 5 and source S is connected through the load resistor 14 to electrode 7, but the load resistor 14 is embedded also in the insulator disc 1. Three terminals A, B, and C are similarly provided.

In the both devices of FIGS. 1 and 2, the outer ionization chamber 8 is greater in volume than the inner ionization chamber 9, and the atmospheres in the both ionization chambers 8 and 9 are always irradiated and ionized by the radiant ray from the radioactive source 7.

Figure 3:
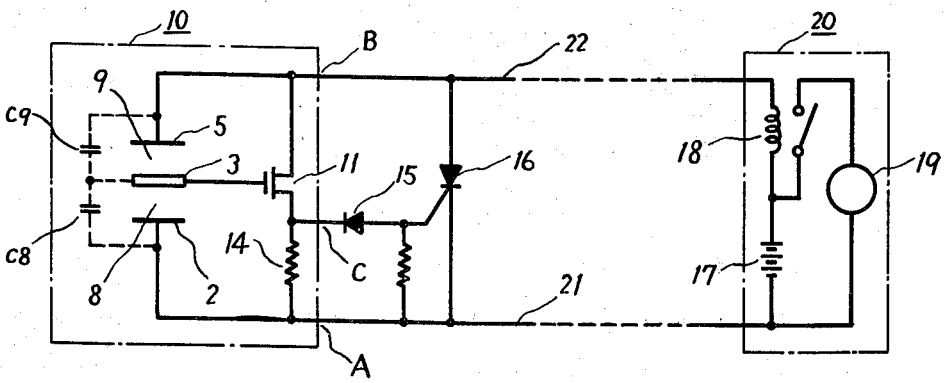
FIG. 3 is a schematic circuit diagram representing a fire detecting device which embodies an ionization smoke detector according to this invention.

Referring next of FIG. 3, there shown is a circuit configuration of a fire detecting device including an ionization smoke detector 10 of the type described in conjunction with FIGS. 1 and 2, which is enclosed by a broken line. Same reference numerals indicate the corresponding structural elements of the devices in FIGS. 1 and 2. Capacitors C8 and C9 indicate respectively the inherent capacitances between the outer and intermediate electrodes and between the intermediate and inner electrodes.

The terminals A and B of the detector 10 are respectively connected to the negative and positive conductors 21 and 22 from a receiver unit 20 including a power supply 17 which supplies an operation voltage through the conductors 21 and 22 to the detector 10.

The terminal C is connected through a zener diode 15 to the control electrode of a silicon controlled rectifier 16 having its conduction path connected between the conductors 21 and 22.

In the receiver unit 20, the power supply 17 is connected in series with the electromagnet coil of a relay 18 betwen the both conductors 21 and 22 and an alarm device 19 is connected in series with the contact of the relay 18 between the both terminals of the power supply 17.

In operation, if smoke enters the outer ionization chamber 8, a part thereof also enters the inner ionization chamber 9. However, since the outer ionization chamber 8 is greater in volume than the inner ionization chamber 9, the resultant impedance change is very little in the inner ionization chamber 9 but is very large in the outer ionization chamber 8. This results in a significant change in a potential at the intermediate electrode 3, that is, at the gate electrode of the field effect transistor 11, which results in turn in an increase of the source-drain current of the field effect transistor 11 and a voltage increase at the source electrode thereof. When the source voltage exceeds the zener voltage of the zener diode 15, the voltage is applied to the control electrode of the silicon controlled rectifier 16 to drive it into conduction. Thus the conductors 21 and 22 are short-circuited to energize the relay 18 and the alarm device 19 in the receiver unit 20. The zener diode 15 serves the function of preventing the smoke detector 10 from being operated by small quantities of smoke or noise.

Electrostatic capacitances C8 and C9 exist between the electrodes 2 and 3 and between the electrodes 3 and 5, respectively. If C8 is less than C9, the source voltage of the field effect transistor 11 rises instantaneously to drive the silicon controlled rectifier 16 into conduction when the power supply is energized. Therefore, C8 must be maintained always greater than C9. For this purpose, the thickness or dielectric constant or the insulator disc members 1 and 4 may be selected appropriately.

Since the currents flowing between the respective electrodes 2, 3, and 5 and through the field effect transistor 11 are very low, the relay 18 in the receiver unit 20 is never energized unless the silicon controlled rectifier 16 is driven into conduction. Once energized, however, it can energize the alarm device continuously according to the holding effect of the silicon controlled rectifier 16 until the power supply is turned off.

What is claimed is:

1. An ionization smoke detector comprising an inner electrode, means including an air permeable intermediate electrode enclosing said inner electrode, means including an air permeable outer electrode enclosing said inner and intermediate electrodes, said intermediate electrode defining an inner chamber which includes said inner electrode and said intermediate and outer electrodes defining an outer chamber of substantially greater volume than said inner chamber and a radioactive source disposed within one of said chambers to ionize the gas within the last said chamber, the radioactive emission from said source penetrating said intermediate electrode to ionize the gas within the other of said chambers.

2. An ionization smoke detector according to claim 1 wherein said radioactive source is disposed within the outer chamber.

3. An ionization smoke detector according to claim 1 wherein said inner, intermediate and outer electrodes are of rectangular configuration.

4. An ionization smoke detector according to claim 1 wherein said inner, intermediate and outer electrodes are of semicircular configuration.

* * * * *